US005918875A

United States Patent [19]

Masley et al.

[11] Patent Number: 5,918,875

[45] Date of Patent: Jul. 6, 1999

[54] ZERO CLEARANCE HANDLE

[75] Inventors: John R. Masley, Farmington; Jacob W. Patla, Fairport, both of N.Y.

[73] Assignee: Xerox Corporation, Stamford, Conn.

[21] Appl. No.: 08/895,873

[22] Filed: Jul. 17, 1997

[51] Int. Cl.[6] ..... B65H 1/00

[52] U.S. Cl. ..... 271/162; 271/164; 271/145; 312/332.1

[58] Field of Search ..... 271/162, 164, 271/145; 312/332.1

[56] References Cited

U.S. PATENT DOCUMENTS

| | | | |
|---|---|---|---|
| 3,239,298 | 3/1966 | McCarthy | 312/332.1 |
| 3,936,042 | 2/1976 | Smith et al. | 271/9 |
| 5,120,045 | 6/1992 | Kamezaki et al. | 271/162 |
| 5,157,448 | 10/1992 | Lang | 355/309 |
| 5,307,116 | 4/1994 | Ikunami et al. | 355/207 |

FOREIGN PATENT DOCUMENTS

| | | | |
|---|---|---|---|
| 153130 | 5/1992 | Japan | 271/162 |
| 164727 | 6/1992 | Japan | 271/162 |

*Primary Examiner*—William E. Terrell
*Assistant Examiner*—Patrick Mackey
*Attorney, Agent, or Firm*—John S. Wagley

[57] ABSTRACT

A media tray for storing a supply of media for use in a printing apparatus is provided. The media tray includes a body having a tray for storing the media, a cover and a handle. The cover includes a front face. The front face is opposed to the body. The cover has an opening. The cover is attached to a first end of the body. The handle is pivotably secured to the cover about a handle pivoting axis. The handle is positioned at least partially adjacent the opening of the cover. The handle is removably connectable with the printing apparatus. The handle pivoting axis is located outside the volume normal to the face whose cross sectional area is defined by the predetermined periphery of the cover at the front face.

12 Claims, 5 Drawing Sheets

ZERO CLEARANCE HANDLE

This invention relates to electrostatographic printing machines, and, more particularly, to an electrostatographic printing system having media trays.

Generally, the process of electrostatographic reproduction is executed by exposing a light image of an original document to a substantially uniform charged photoreceptive member. Exposing the charged photoreceptive member to a light image discharges the photoconductive surface thereof in areas corresponding to non-image areas in the original document while maintaining the charge on the image areas to create an electrostatic latent image of the original document on the photoconductive surface of the photoreceptive member. The latent image is subsequently developed into a visible image by depositing a charged developing material onto the photoconductive surface so that the developing material is attracted to the charged image areas thereon. The developing material is then transferred from the photoreceptive member to an output copy sheet on which the image may be permanently affixed in order to provide a reproduction of the original document. In a final step in the process, the photoreceptive member is cleaned to remove any residual developing material on the photoconductive surface thereof in preparation for successive imaging cycles.

The electrostatographic copying process described above is well known and is commonly used for light lens copying of an original document. Analogous processes also exist in other electrostatographic printing applications such as, for example, ionographic printing and reproduction, where charge is deposited on a charge retentive surface in response to electronically generated or stored images.

In the printing machines described above, the copies are produced by transferring development material onto copy sheets. These copy sheets are typically stored within the printing machine. The sheets are stored internally within the machine in order to protect the copy substrate from contamination and to stage the copy sheets for cooperation with the feed rolls of the paper feeding portion of the copy machine. Typically, to permit for easy loading of additional paper into the paper trays, the trays are mounted on ways or guides and may be slid horizontally forwardly from the front of the machine. A handle is typically used near the front of the tray for pulling the tray outwardly from the machine. The handle may include a mechanism that is attached to a latch to unlock the tray to permit the sliding of the tray forward.

To provide for improved safety and appearance, typically, the handle is recessed into the front face of the paper tray. Typically, the hand grip area or recessed are in the front of the tray is too small for an operator's fingers to comfortably fit within the recess. Also, the mechanism used to lock and unlock the tray is often difficult to adjust. Further, the mechanism used to secure or lock the tray to the sliding mechanism is subject to wear. Further, the mechanism used to latch the tray to the sliding mechanism may include an expensive and difficult to assemble spring to secure the tray to the sliding mechanism.

The present invention is intended to overcome at least a portion of these problems.

The following disclosures appear to be relevant:

U.S. Pat. No. 5,307,116

Patentee: Ikunami et al.

Issued: Apr. 26, 1994

U.S. Pat. No. 5,157,448

Patentee: Lang

Issued: Oct. 20, 199

2

U.S. Pat. No. 5,120,045

Patentee: Kamezaki et al.

Issued: Jun. 9, 1992

U.S. Pat. No. 3,936,042

Patentee: Smith et al.

Issued: Feb. 3, 1976

The relevant portions of the foregoing disclosures may be briefly summarized as follows:

U.S. Pat. No. 5,307,116 discloses a copier or printer for forming an image of a document on a recording paper. The printer includes a paper feed tray for holding the paper and a conveying unit for conveying paper from the paper feed tray. The printer also includes an image forming section for forming a toner image of the document onto the paper and a fixing unit for fixing the toner onto the paper. The printer further includes a detector for detecting a paper jam and for generating a detection signal. The printer also includes a locking member with a solenoid for locking one of the units in another. Also the printer includes a controller for controlling the locking member according to the detection signal so that all of the units are resisted from being removed separately when the jam occurs.

U.S. Pat. No. 5,157,448 discloses a copy machine paper loading drawer interlock system. The system provides protection from jams by preventing drawer opening during sheet feeding. The system provides more frequent and rapid drawer access for copy paper drawer loading. This feature is particularly desirable for loading one drawer while running the machine and feeding sheets from another drawer. Each paper drawer thereof is independently operating from the existing wiring and electrical signals for the paper feeder drive for that drawer without any wiring or software requirements from the machine controller. Further no matching cycleout signals are required or actuation of any manually actuated unlocking switches.

U.S. Pat. No. 5,120,045 discloses a sheet transport device with a removably attached sheet tray. The sheet tray is attached to the body of an apparatus pivotably moveable to an upright or unfolded position. The sheet tray has pivots projection form the respective opposite sides of the base end of the tray and each has a first width when the tray in the upright position and a second width larger than the first width when the tray in an unfolded position. That body has cutouts for their respective pivots, each having an inlet portion with a width larger than the first width and smaller than the second width. An elastic member restrains the pivot from rotating.

U.S. Pat. No. 3,936,042 discloses a sheet feeding mechanism for a reproduction machine including a plurality of trays for supporting sheets of various sizes which are to be fed into the machine. A baffle plate is provided for each tray for guiding the sheets from that tray upwardly to a sheet separating roller assembly.

In accordance with one aspect of the invention, there is provided a media tray for storing a supply of media for use in a printing apparatus. The media tray includes a body having a tray for storing the media, a cover and a handle. The cover includes a front face and is opposed to the body. The front face has an opening. The cover is attached to a first end of the body. The handle is pivotably secured to the cover about a handle pivoting axis. The handle is positioned at least partially adjacent the opening of the cover. The handle is removably connectable with the printing apparatus. The handle pivoting axis is located outside the volume normal to the face whose cross sectional area is defined by the predetermined periphery of the cover at the front face.

In accordance with another aspect of the present invention, there is provided a printing apparatus including a media tray for storing a supply of media for use in the printing apparatus. The media tray includes a body having a tray for storing the media, a cover and a handle. The cover includes a front face. The front face is opposed to the body. The front face has an opening. The cover is attached to a first end of the body. The handle is pivotably secured to the cover about a handle pivoting axis. The handle is positioned at least partially adjacent the opening of the cover. The handle is removably connectable with the printing apparatus. The handle pivoting axis is located outside the volume normal to the face whose cross sectional area is defined by the predetermined periphery of the cover at the front face.

For a general understanding of the present invention, as well as other aspects thereof, reference is made to the following description and drawings, in which like reference numerals are used to refer to like elements, and wherein.

While the present invention will be described with a reference to preferred embodiments thereof, it will be understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

Figure 5:
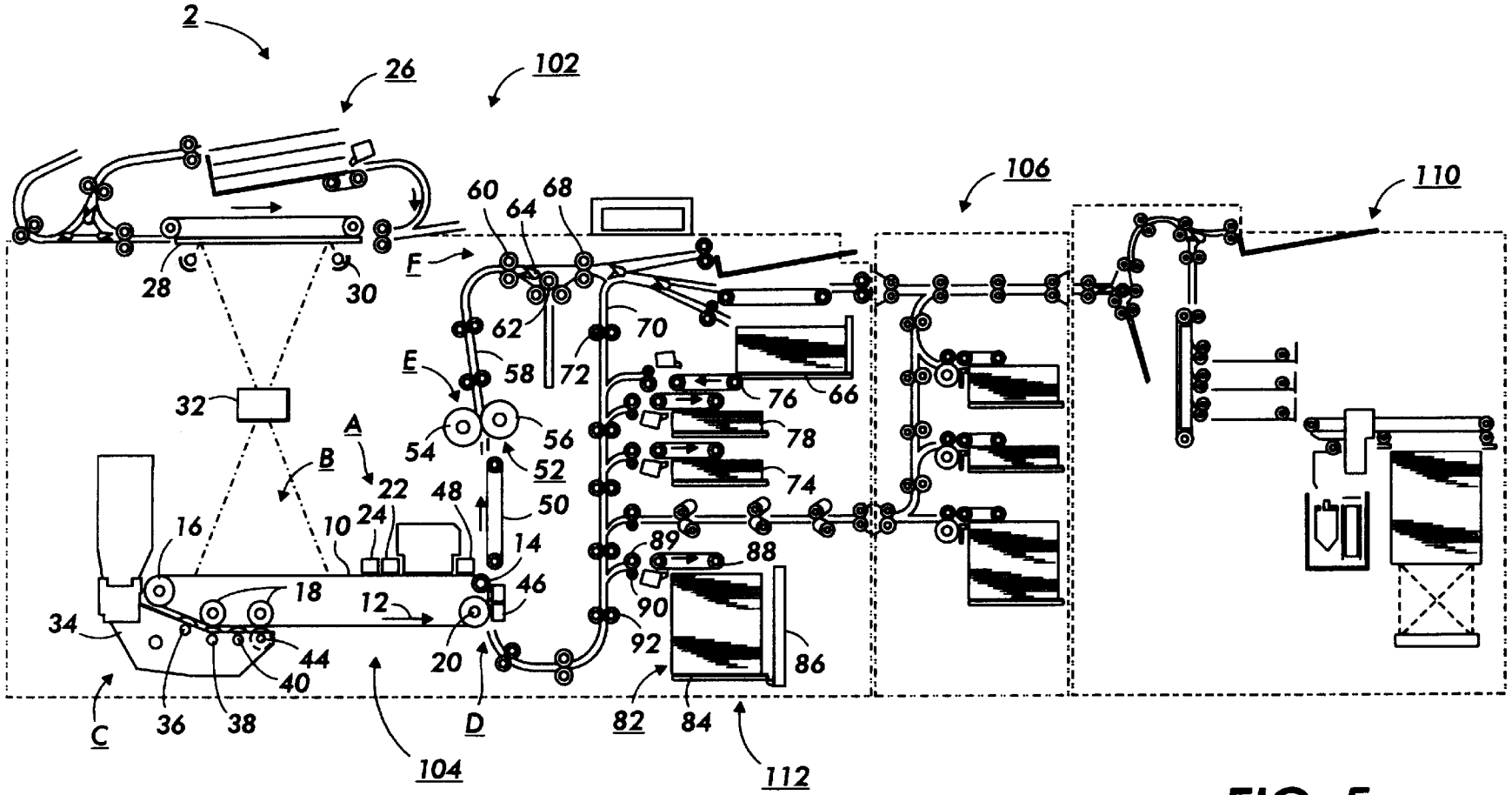
FIG. 5 is a schematic elevational view of a printing machine incorporating the paper tray including the zero clearance handle according to the present invention.

Inasmuch as the art of electrostatographic processing is well known, the various processing stations employed in a typical electrostatographic copying or printing machine of the present invention will initially be described briefly with reference to FIG. 5. It will become apparent from the following discussion that the paper feeding system of the present invention is equally well suited for use in a wide variety of other electrophotographic or electronic printing systems, as for example, ink jet, ionographic, laser based exposure systems, etc.

Turning initially to FIG. 5, prior to discussing the invention in detail, a schematic depiction of an exemplary electrophotographic reproducing machine 2 incorporating various subsystems is furnished wherein a photoconductive belt 10 is employed, preferably comprising a photoconductive material coated on a ground layer, which, in turn, is coated on an anti-curl substrate. The photoconductive material typically includes a transport layer, which may contain molecules of di-m-tolydiphenylbiphenyldiamine dispersed in a polycarbonate, coated on a generator layer, generally made from trigonal selenium. The grounding layer is typically made from a titanium coated Mylar (a trademark of E.I. duPont de Nemours and Company (UK) Ltd.)(a polyester film). Of course, other suitable photoconductive materials, ground layers, and anti-curl substrates may also be employed.

Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under a desired tension. Drive roller 20 is rotated by a motor (not shown) coupled thereto by any suitable means such as a drive belt. Thus, the rotational movement of roller 20 advances belt 10 in the direction of arrow 12 to advance successive portions of the photoconductive surface sequentially through the various processing stations disposed about the path of movement thereof.

Initially, a portion of photoconductive belt 10 passes through charging station A whereat two corona generating devices, indicated generally by reference numerals 22 and 24, charge photoconductive belt 10 to a relatively high, substantially uniform potential. This dual or "split" charging system is designed so that corona generating device 22 places all of the required charge on photoconductive belt 10 while corona generating device 24 acts as a leveling device to provide a uniform charge across the surface of the belt. Corona generating device 24 also fills in any areas which may have been missed by corona generating device 22.

Next, the charged portion of photoconductive belt 10 is advanced through imaging station B, whereat an original document to be reproduced is placed on platen 28 for being imaged onto the charged photoconductive belt 10. Imaging of the document is achieved by two flash lamps 30 mounted in the optics cavity for illuminating the document on platen 28. Light rays are reflected from the document and transmitted through lens 32 which focuses the light image of the original document onto the charged portion of the photoconductive surface of belt 10 to selectively dissipate the charge thereon. This records an electrostatic latent image on photoconductive belt 10 corresponding to the informational areas contained within the original document.

It is noted that, at imaging station B, a document handling unit, indicated generally by reference numeral 26, may be positioned over platen 28 of the printing machine. The document handling unit 26 sequentially feeds documents from a stack of documents placed in a document stacking and holding tray such that the original documents to be copied are loaded face up into the document tray on top of the document handling unit. Using this system, a document feeder, located below the tray, feeds the bottom document in the stack to a pair of rollers for advancing the document onto platen 28 by means of a belt transport which is lowered onto the platen with the original document being interposed between the platen and the belt transport. When the original document is properly positioned on platen 28, the document is imaged and the original document is returned to the document tray from platen 28 by either of two paths. If a simplex copy is being made or if this is the first pass of a duplex copy, the original document is returned to the document tray via a simplex path. Conversely, if this is the inversion pass of a duplex copy, then the original document is returned to the document tray through a duplex path.

At development station C, a magnetic brush developer housing, indicated generally by the reference numeral 34, is provided, having three developer rolls, indicated generally by the reference numerals 36, 38 and 40. A paddle wheel picks up developer material, generally comprising triboelectrically charged carrier granules and toner particles, in the developer housing 34 for delivering the developer material to the developer rolls. When the developer material reaches rolls 36 and 38, it is magnetically split between the rolls with approximately half of the developer material being delivered to each roll. Photoconductive belt 10 is situated adjacent rolls 36 and 38 for attracting toner particles from an extended development zone formed thereby. Developer roll 40 is a cleanup roll and magnetic roll 44 is a carrier granule removal device adapted to remove any carrier granules adhering to belt 10. Thus, rolls 36 and 38 advance developer material into contact with the electrostatic latent image, which may include the additional image information provided by the annotation system, whereby the latent image attracts toner particles from the carrier granules of the developer material to form a toner powder image on the photoconductive surface of belt 10.

After development, belt 10 then advances the toner powder image to transfer station D, where a sheet of support material or a copy sheet (not shown) is moved into contact with the toner powder image. A corona generating device 46 charges the copy sheet to a proper potential so that the sheet is electrostatically secured or "tacked" to belt 10. Corona generating device 46 also provides electrostatic fields for attracting the toner image from the photoreceptor belt 10 to the copy sheet. Thus, the transfer station operates to induce contact between the developed image on belt 10 and the sheet of support material for transfer of the toner image thereto.

A high capacity feeder, indicated generally by the reference numeral 82, is the primary source of copy sheets. High capacity feeder 82 includes a tray 84 supported on an elevator 86. The elevator is driven by a bi-directional motor to move the tray up or down. In the up position, the copy sheets are advanced from the tray to transfer station D. A vacuum feed belt 88 feeds successive uppermost sheets from the stack to a take away roll 89 and rolls 92. The take-away roll 89 and rolls 92 guide the sheet onto conveyor 70, which, in turn, move the sheet into the transfer zone at transfer station D.

After the developed image is transferred to the copy sheet, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to fusing station E.

Fusing station E includes a fuser assembly, indicated generally by the reference numeral 52, for permanently affixing the transferred toner powder image to the copy sheet. Preferably, fuser assembly 52 includes a heated fuser roller 54 and a pressure roller 56. The developed copy sheet is transported to the fusing station with the powder image on the copy sheet contacting fuser roller 54. The pressure roller 56 abuts the fuser roller 54 to provide the necessary pressure to fix the toner powder image to the copy sheet. In this exemplary fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl as well as any other curls or wrinkles which may have been introduced into the copy sheet. The copy sheet is then advanced, via forwarding roller pairs 60 to duplex turn roll 62. A duplex solenoid gate 64 selectively guides the copy sheet to finishing station F or to duplex tray 66. In the finishing station, the copy sheets are collected in sets and the copy sheets of each set can be stapled or glued together.

Alternatively, the solenoid activated gate 64 can be used to divert the sheet into duplex tray 66, providing intermediate storage for those sheets that have been printed on one side and on which an image will be subsequently printed on the second, opposed side thereof, i.e. the sheets being duplexed. Duplex sheets are typically stacked in duplex tray 66 face down in a configuration, one on top of another, in the order in which they are copied. In order to complete duplex copying, the simplex sheets in tray 66 are fed, in seriatim, by a bottom feeder 68, from tray 66 back to transfer station D, via conveyor 70 and rollers 72. These sheets are then transported back to the transfer station for transfer of a toner powder image to the opposite sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets may also be fed to transfer station D from a secondary tray 74 or an auxiliary tray 78 for providing additional sheet capacity on special types of copy sheets. Each tray includes an elevator driven by a bi-directional AC motor and a controller having the ability to drive the tray up or down. When the tray is in the down position, stacks of copy sheets are loaded thereon or unloaded therefrom. In the up position, successive copy sheets may be dispersed therefrom by a sheet feeder 76. Sheet feeder 76 may comprise a friction retard feeder, as shown schematically in FIG. 5, utilizing a feed belt and take-away rolls to advance successive copy sheets to transport 70 which, in turn, advances the sheets to rolls 72 and then to transfer station D. It will be recognized that secondary tray 74 and auxiliary tray 78 are supplemental sources of copy sheets for providing machine adaptability and flexibility for particular print jobs.

The foregoing description should be sufficient for the purposes of the present disclosure for patent to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

Figure 4:
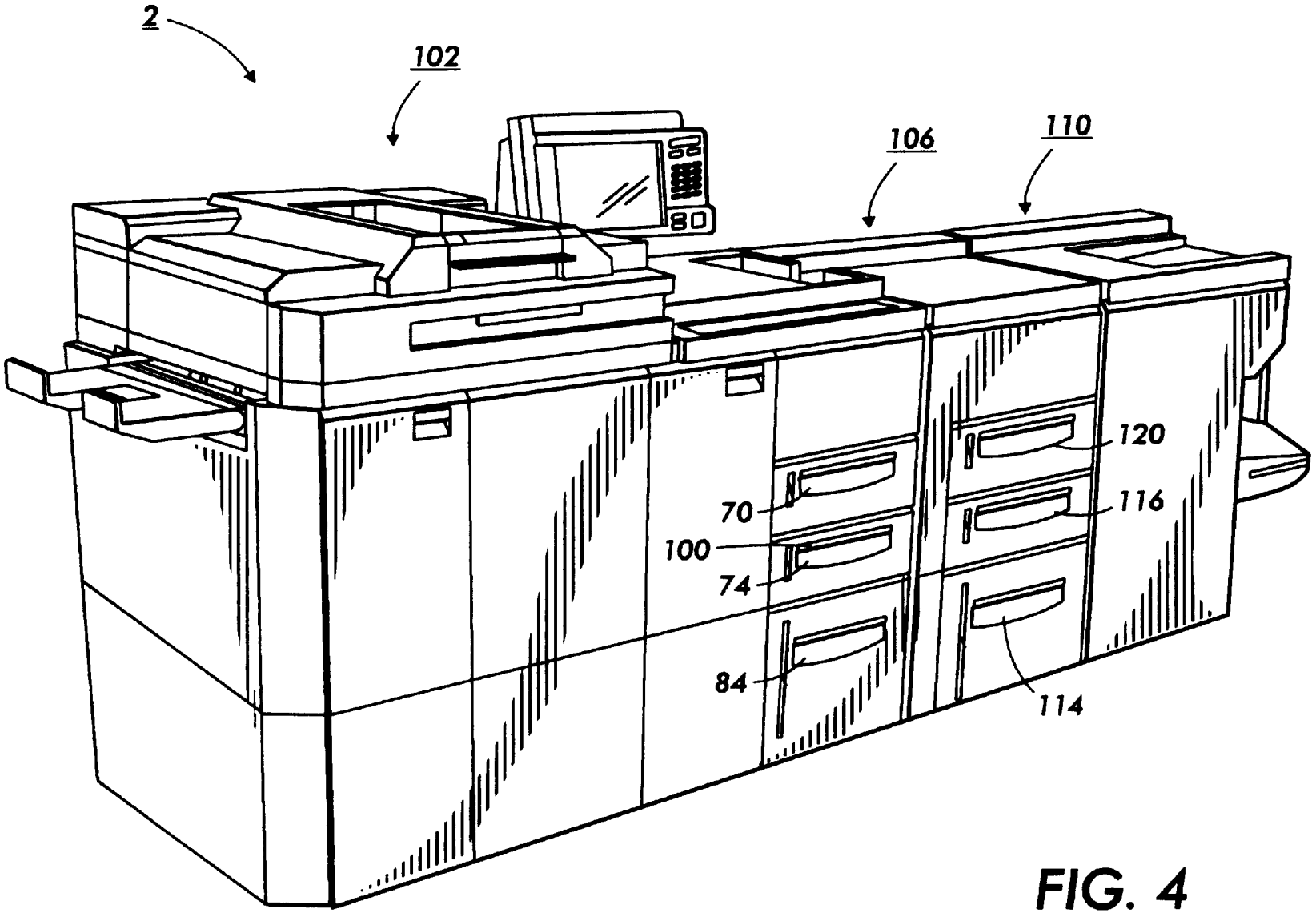
FIG. 4 is a perspective view of a printing machine incorporating the paper tray including the zero clearance handle according to the present invention.

According to the present invention and referring to FIG. 4, a handle 100 is shown attached to high capacity tray 84 of the copy machine 2. The copy machine 2 includes a printing module 102. The printing module 102 includes print engine 104 as shown in FIG. 5.

Referring again to FIG. 4, the copy machine 2 may optionally include, as shown in FIG. 4, an interposer 106. The interposer 106 provides for additional paper handling capacity. Further, the copy machine 2 may optionally include a finisher 110 for providing finishing operations, e.g. for folding, collating, or stapling, as well as, binding finished copies.

The printing module 102 of the copy machine 2 includes a paper module 112 which includes the high capacity tray 84. It should be appreciated that the handle 100 of the present invention may be well suited for the high capacity tray 84 as well as for the secondary tray 74 and the auxiliary tray 70 of the paper module 112. Similarly, the interposer 106 which includes trays for storing additional paper, typically includes more than one tray, e.g. as shown in FIG. 4, the interposer 106 includes a high capacity interposer tray 114, a secondary interposer tray 116 as well as an auxiliary interposer tray 120. It should be appreciated that the high capacity interposer tray 114, the secondary interposer tray 116 and the auxiliary interposer tray 120 may all likewise utilize the handle 100 of the present invention.

Figure 3:
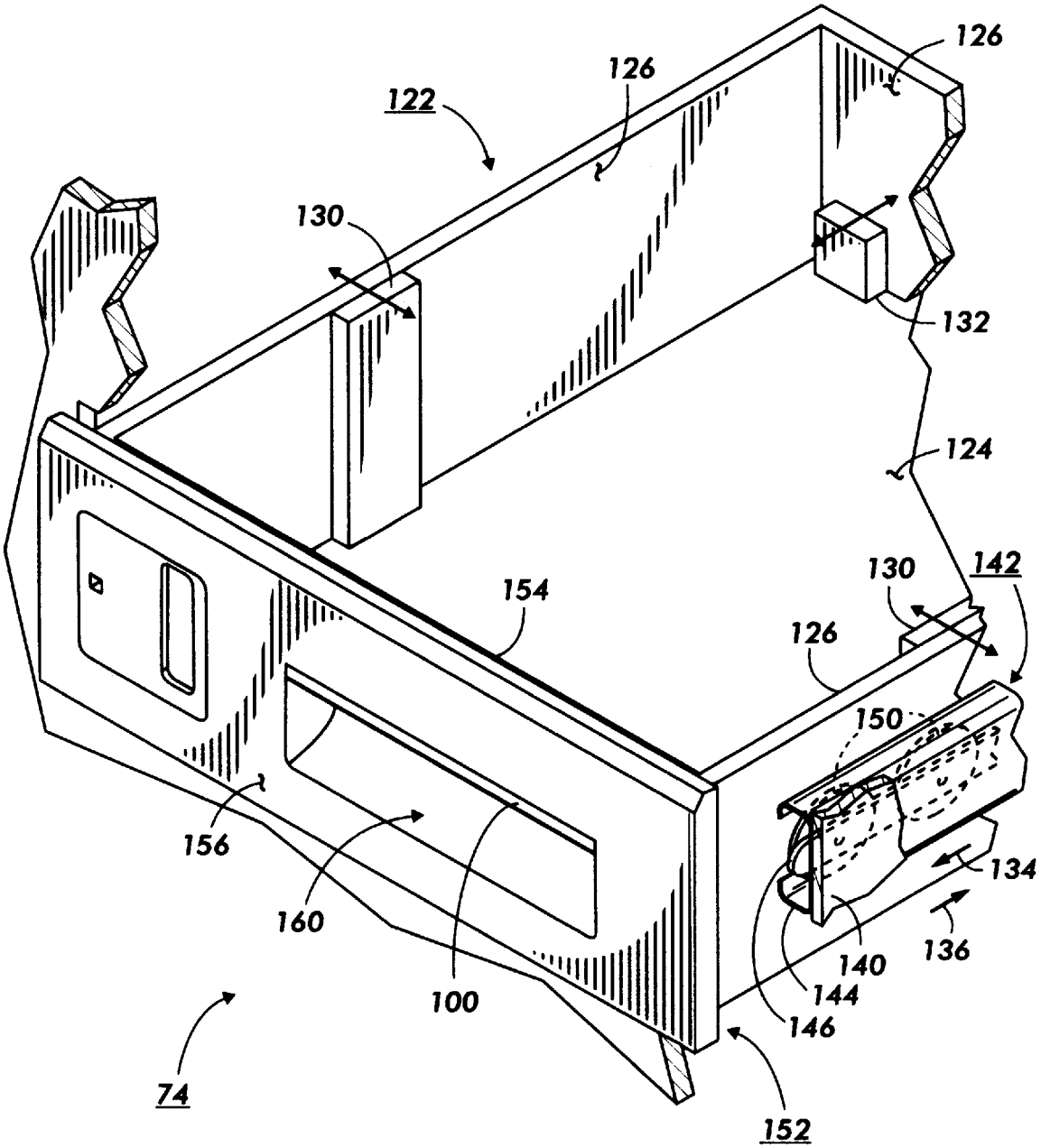
FIG. 3 is a partial perspective view of the FIG. 1 paper tray including the zero clearance handle.

Referring now to FIG. 3, the handle 100 is shown installed onto secondary tray 74. The tray 74 includes a body 122. The body 122 includes a bottom 124 for supporting the paper as well as sidewalls 126 extending upwardly from the bottom 124. To accommodate a variety of sizes of paper, for example, from 11×17 inch to A4 and 8½ by 11 inch paper, the tray 74 preferably includes adjustable side guides 130 and adjustable end guide 132 which are movably secured to the body 122 and provide for adjustable guides for the edges of various size papers.

The tray 74 is slidably mounted to the copy machine in any suitable fashion such that the tray 74 may be slid outward in the direction of arrow 134 and inwardly in the direction of arrow 136. While it should be appreciated that any suitable device may be used to provide for the sliding of the tray 74, for example, as shown in FIG. 3, the body 122 of the tray 74 is slidably mounted to machine frame 140 of the copy machine 2 by means of rail assembly 142. While rail assembly 142 is shown mounted onto one of the walls 126, it should be appreciated that a similar rail assembly 142 may be mounted likewise on the opposed wall 126. The rail assembly 142 includes rail 144 fixedly secured to the machine frame 140. Carriage 146 is mounted to side wall 126 of the body 122 of the tray 74. The carriage 146 is slidably fitted to the rail 144 and guides the tray 74 as it is slid in the direction of arrows 134 and 136. For example, the carriage 146 may include rollers 150 which mate with the rail 144.

A cover 152 extends forwardly from front end 154 of the body 122. It should be appreciated that the cover 152 may be secured to one of the walls 126 of the body 122 or be integral with one of the walls 126. The cover 152 includes a front face 156 opposed to body 122 of the tray 74. An aperture 160 is formed in the front face 156 of the cover 152. The handle 100 is positioned at least partially within the opening 160. As shown in FIG. 3, the handle 100 is positioned near the upper portion of the opening 160.

The opening 160 is of sufficient size and shape to permit a person's fingers to reach below the front face 156 of the cover 152 and actuate the handle 100.

Figure 1:
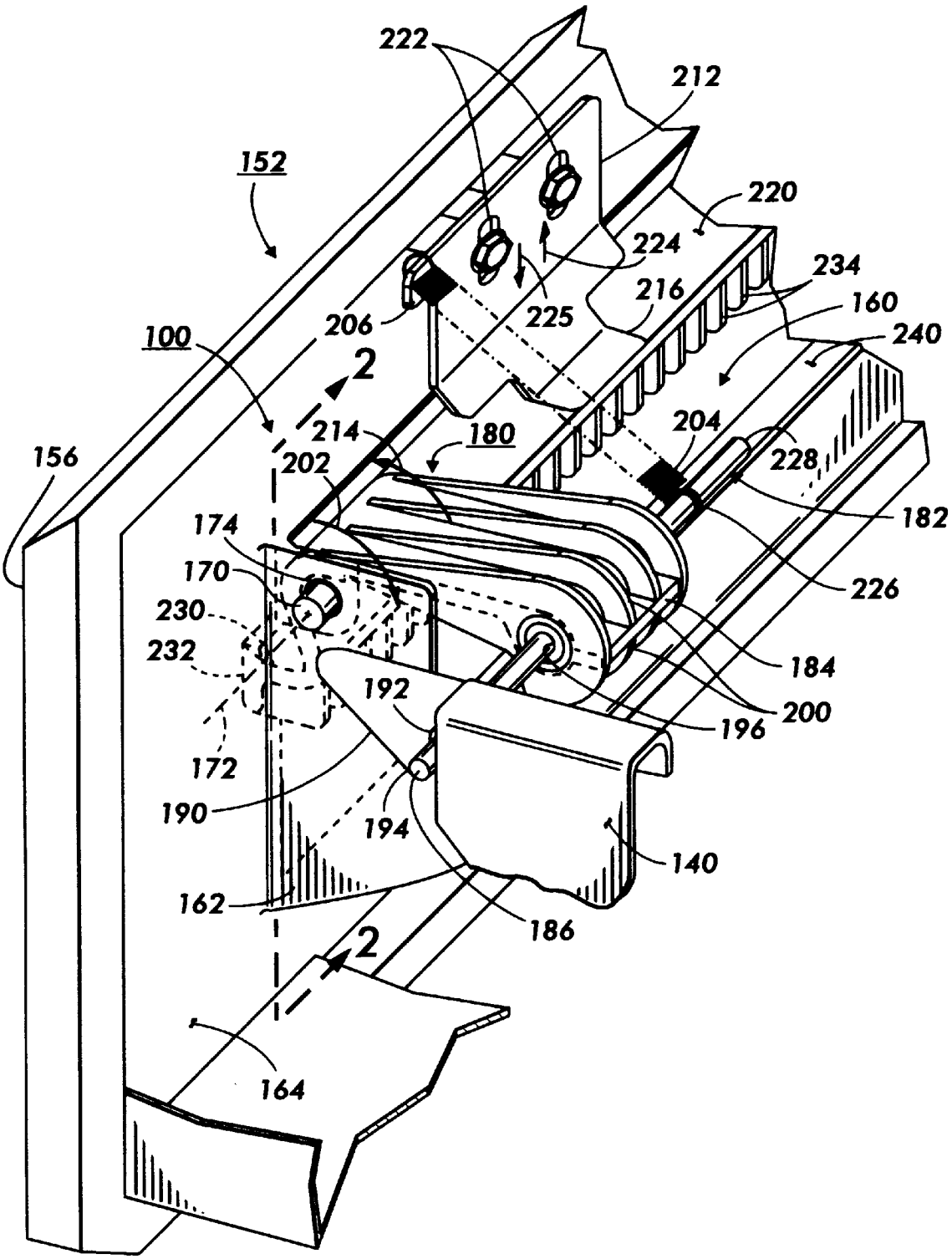
FIG. 1 is a partial perspective view of a paper tray including the zero clearance handle according to the present invention.

Referring now to FIG. 1, the handle 100 of the present invention is shown in greater detail. According to the present invention, the handle 100 is configured to provide releasable engagement with the copy machine 2, such that the tray 74 may be locked into a first closed position and unlocked into a second open position. The handle 100 is pivotally mounted to the tray 74 in any suitable fashion. For example, as shown in FIG. 1, the handle 100 includes a bracket 162 extending inwardly from inner face 164 of cover 152.

It should be appreciated that the bracket 162 may be a separable piece from the cover 152 or may be integrally molded therewith. The bracket 162 includes apertures 166 about which pivot pin 170 pivotally rotates. The pivot pin 170 thus defines pivot axis 172.

The handle 100 includes a pivot pin bore 174 within which the pivot pin 170 is fittably located. To permit rotation of the handle 100, it should be appreciated that the pivot pin 170 may be rotatably fitted to the aperture 166, the pivot pin 170 may be rotatably fitted to the pivot pin bore 174 of the handle 100 or the pivot pin 170 may be pivotally fitted to both the pivot pin bore 174 and the aperture 166. The pivot pin 170 may be made of any suitable durable material, i.e. a plastic or a metal. Preferably, the pivot pin 170 is made of carbon steel.

The bracket 162 and the cover 152 may be made of any suitable durable material. The cover 152 is preferably made of a durable plastic, i.e. polypropylene. The bracket 162 may be made of sheet metal and adjoined to the cover 152 or the bracket 162 may be integrally molded with the cover 152 and be made of a suitable plastic.

The handle 100 includes a first arm 180 extending outwardly from the pivot axis 172 of the handle 100. The first arm 180 cooperates with the machine frame 140 of the copy machine 2 to selectively engage and disengage the cover 152 with the machine frame 140. The first arm 180 can engage the machine frame 140 in any suitable fashion. For example, as shown in FIG. 1, the first arm 180 includes a pin 182 located near distal end 184 of the first arm 180.

The pin 182 includes a first end 186 of the pin 182 which extends outwardly from the first arm 180 and engages with latch 190. The latch 190 is secured to machine frame 140. As shown in FIG. 1, the latch 190 is fixedly secured to the machine frame 140. A notch 192 is formed in the latch 190 and extends upwardly from lower surface 194 of the latch 190. The notch 192 engages with the first end 186 of pin 182 securing the tray 74 in a closed or locked position.

The pin 182 may be made of any suitable durable material, e.g. steel. The pin 182 may be secured to the first arm 180 of handle 100 in any suitable fashion such as by fitting the pin 182 interferencely with a locking pin bore 196 of the first arm 180.

The pin 182 preferably includes a groove 226 to provide a position for securing the spring 204 thereto. As shown in FIG. 1, the pin 182 includes a second end 228 extending outwardly from first arm 180. Preferably, to provide for the wear of the first end 186 of pin 182 when interconnecting with notch 192 of latch 190, the pin 182 is reversible. In other words, the pin 182 is symmetrical with first end 228 and second end 186 of pin 182 being reversible. When first end 186 of pin 182 becomes worn, the pin 182 may be turned end for end with what was the second end 228 of the pin 182 now engaging the latch 190.

The first arm 180 may extend substantially the length of the pin 182, or as shown in FIG. 1, be positioned near latch 190.

The first arm 180 may have any suitable shape but preferably includes ribs 200 to provide additional strength at low weight. The first arm 180 is rotatable in the direction of arrow 202 from the locked position as shown in FIG. 1 to an unlocked position (see FIG. 2 in phantom). A biasing means 204 is used to bias the first arm 180 into the locked position shown. The biasing means 204 may be any suitable biasing mechanism capable of maintaining the first arm 180 in the locked position. For example, as shown in FIG. 1, the biasing means 204 may be in the form of a spring. For example, the spring 204 may be a coil spring. The spring 204 is preferably made from spring steel. The spring 204 is secured at one end to the pin 182 and at an opposed end to the cover 152. For example, as shown in FIG. 1, the spring 204 may be secured to the cover 152 by a protrusion 206 extending from adjustable stop 212.

The rotation of the handle 100 in the direction of arrow 214 opposed to arrow 202 may be limited by any suitable fashion. For example, the motion may be limited by the pin 184 resting against a latch 190. Preferably, however, the stop 212 is used to limit the rotation of the handle 100 in the direction of arrow 214. The adjustable stop 212 may be made of any suitable material, e.g. sheet metal. This stop 212 includes a contact surface 216 which contacts surface 220 of the handle 100.

Preferably, the stop 212 is adjustable to limit the rotation of the first arm 180 in the direction of arrow 214 a variable amount. This may be accomplished in any suitable manner such as shown in FIG. 1 by elongated slots 222 in the stop 212 which will permit motion of the adjustable stop 212 in the direction of arrows 224 and 225. By adjusting the adjustable stop 212, the angular position of the handle 100 when the locked position can be adjusted.

Further extending outwardly from pivot axis 172 of the handle 100 is a second arm 230. Second arm 230 includes a second arm front face 232 located on the distal end of second arm 230. To improve the appearance of the tray 74, preferably, the second arm front face 232 is flush or coplanar with front face 156 of cover 152 giving the tray a smooth or streamlined appearance.

The second arm front face 232 can be adjusted to be very accurately flush with front face 156 of cover 152 by adjusting the adjustable stop 212 accordingly.

The second arm 230, similarly to first arm 180, may include ribs 234 to provide for additional strength with minimal weight.

The ribs 234 are similar to ribs 200 of first arm 180. The second arm 230 preferably extends in the direction along pivot axis 172 substantially the length of the opening 160. The second arm 230 serves as a grip for engaging the handle 100. The ribs 234 therefore also serve to provide additional gripping for the handle 100.

Figure 2:
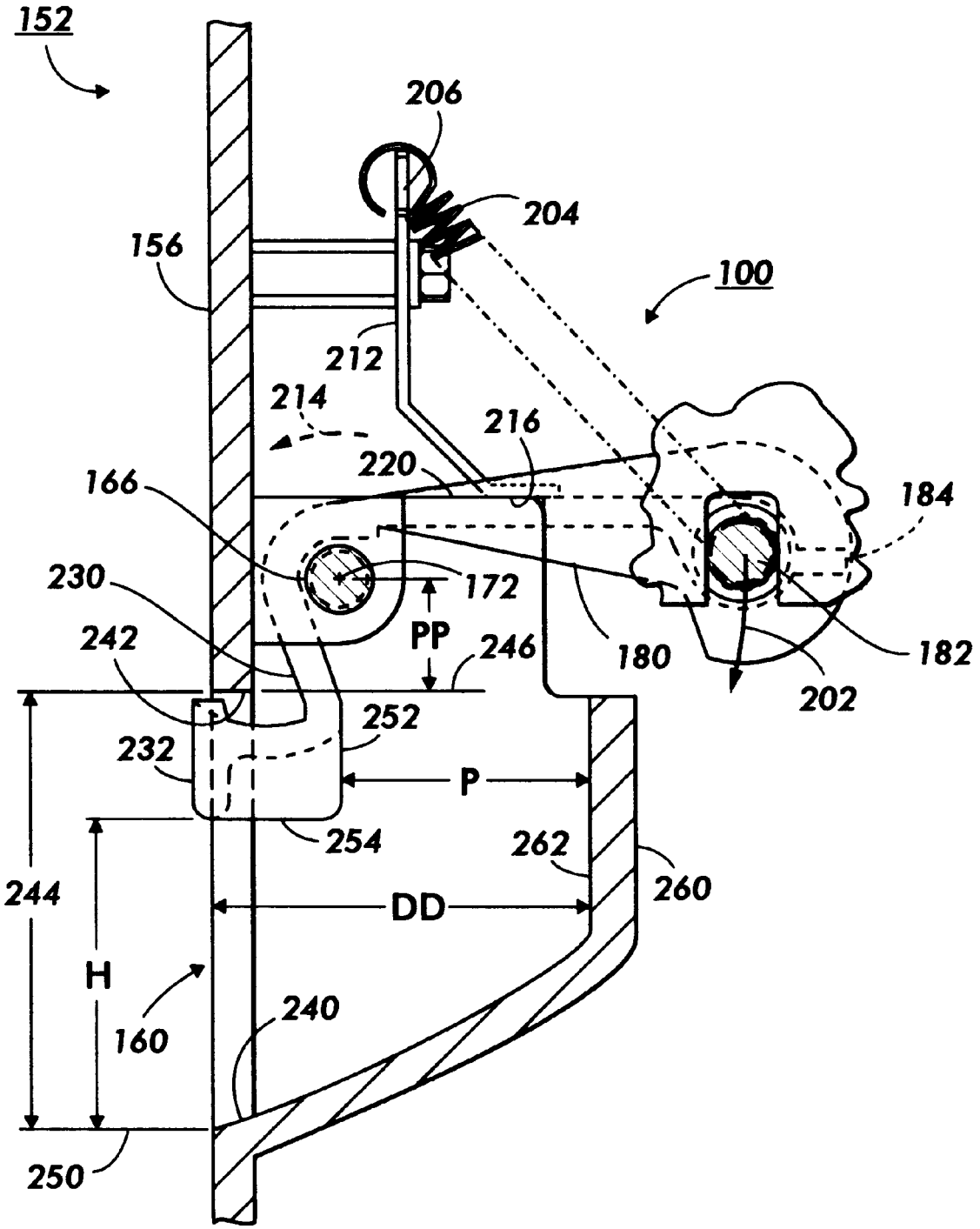
FIG. 2 is a partial sectional view of the FIG. 1 paper tray along the line 2—2 in the direction of the arrows.

Referring now to FIG. 2, the operation of the handle is shown in greater detail. The handle 100 is shown as a solid line in the locked position and in phantom in the unlocked position. Note that in the locked position, front surface 232 of the handle 100 is flush with front face 156 of the cover 152.

The opening 160 as shown in FIG. 2, is formed in cover 152 with a lower periphery 240 and an upper periphery 242. The lower periphery 240 and upper periphery 242 of the opening 160 define a volume 244 of opening 160 normal to cover 152. The volume 244 is bounded by upper plane 246 and lower plane 250. Planes 246 and 250 are normal or perpendicular to front face 156 of cover 152.

To provide sufficient room for an operator's hand behind the second arm 230, i.e. in order that fingertips may contact rear surface 252 of second arm 130, the handle pivot axis 172 is preferably located above upper plane 246 of the volume 244. Preferably, the handle pivot axis is located a distance P above upper plane 246. A dimension P of one-fourth to one inch is preferred.

Lower periphery 240 of opening 160 and lower surface 254 of second arm 230 of handle 100 form a passageway for an operator's fingers within the opening 160. The distance between lower surface 254 and lower periphery 240 is defined by a vertical distance H. The distance H is preferably between one-half to two inches with three-fourths of an inch being preferred.

Preferably, the cover 152 includes a recessed wall 260 parallel and spaced rearwardly from front face 156 of cover 152. The recess wall 260 is recessed a distance D from front face 156 of cover 152. Preferably, the distance D is from 0.5 inches to 2.2 inches with 1.2 inches being preferred.

The second arm 230 is provided with a distance P from rear surface 252 of second arm 230 to inner surface 262 of recessed wall 260 of a sufficient distance such an operator's fingers may engage the second arm 230 at rear surface 252 to unlock the tray 74. Preferably the distance P is 1.0 to 2.5 inches with 1.3 inches being preferred.

By providing a handle with a front surface parallel with the front face of the cover, a drawer is provided with a pleasing visual effect.

By providing a handle for a paper tray with an adjustable stop, a handle may be provided that is adjustably flush with the front cover of the tray.

By providing a paper tray with a release handle which pivots above the opening of the cover, a paper tray may be provided which is slim, attractably appearing, yet, ergonomically easy to actuate.

By providing a paper tray with a latch having a large hand grip which is concealed, a handle which may be easily operated yet appear slim and sleek may be provided.

By providing a paper tray with a handle which is biased with a simple coil spring, a handle may be provided with easily adjustable spring force to optimize easily the ergonomics of operating the handle.

It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. A media tray for storing a supply of media for use in a printing apparatus, the media tray comprising:

a body including a tray for storing the media;

a cover including a front face thereof, the front face opposed to said body, the cover defining an opening therein, said cover attached to a first end of said body; and a handle pivotably secured to said cover about a handle pivoting axis, said handle positioned at least partially adjacent the opening of the cover, said handle removably connectable with the printing apparatus, the handle pivoting axis being located outside the volume normal to the face whose cross sectional area is defined by the predetermined periphery of the opening of the cover at the front face, said handle including a first arm extending outwardly from said pivoting axis, said handle having a locked position wherein the first arm is connectable with the printing apparatus and an unlocked position wherein the first arm is detachable from the printing apparatus;

a spring for biasing said handle toward the locked position; and a pin connected to the first arm, a first end of said pin extending from the first arm for engaging with said body and a second end of said pin adapted for engagement with said biasing means.

2. The media tray of claim 1, wherein the first end of said pin and the second end of said pin are interchangeable.

3. A media tray for storing a supply of media for use in a printing apparatus, the media tray comprising:

a body including a tray for storing the media;

a cover including a front face thereof, the front face opposed to said body, the cover defining an opening therein, said cover attached to a first end of said body; and a handle pivotably secured to said cover about a handle pivoting axis, said handle positioned at least partially adjacent the opening of the cover, said handle removably connectable with the printing apparatus, the handle pivoting axis being located outside the volume normal to the face whose cross sectional area is defined by the predetermined periphery of the opening of the cover at the front face, said handle including a first arm extending outwardly from said pivoting axis, said handle having a locked position wherein the first arm is connectable with the printing apparatus and an unlocked position wherein the first arm is detachable from the printing apparatus, said handle including a second arm extending outwardly from said pivoting axis, the front face including a face front surface thereof, the front surface opposed to said body, the second arm including a second arm front surface thereof, the front surface of the second arm being substantially parallel to the front face of said cover.

4. The media tray of claim 3, wherein the second arm front surface extends beyond the front face of said cover when said handle is in the locked position.

5. A media tray for storing a supply of media for use in a printing apparatus, the media tray comprising:

a body including a tray for storing the media;

a cover including a front face thereof, the front face opposed to said body, the cover defining an opening therein, said cover attached to a first end of said body; and a handle pivotably secured to said cover about a handle pivoting axis, said handle positioned at least partially adjacent the opening of the cover, said handle removably connectable with the printing apparatus, the handle pivoting axis being located outside the volume normal to the face whose cross sectional area is defined by the predetermined periphery of the cover at the front face, said handle including a first arm extending outwardly from said pivoting axis, said handle having a locked position wherein the first arm is connectable with the printing apparatus and an unlocked position wherein the first arm is detachable from the printing apparatus and said handle including a second arm extending outwardly from said pivoting axis, the front face including a face front surface thereof, the front surface opposed to said body, the second arm including a second arm front surface thereof, the front surface of the second arm opposed to said body; and an adjustable stop cooperable with said handle for adjusting the position of the handle when the handle is in the locked position so that the second arm front surface may be positioned with respect to the face front surface so that the second arm front surface is substantially coplanar with the face front surface.

6. A printing apparatus including a media tray for storing a supply of media for use in the printing apparatus, the media tray comprising:

a body including a tray for storing the media;

a cover including a front face thereof, the front face opposed to said body, the cover defining an opening therein, said cover attached to a first end of said body; and a handle pivotably secured to said cover about a handle pivoting axis, said handle positioned at least partially adjacent the opening of the cover, said handle removably connectable with the printing apparatus, the handle pivoting axis being located outside the volume normal to the face whose cross sectional area is defined by the predetermined periphery of the opening of the cover at the front face, said handle including a first arm extending outwardly from said pivoting axis, said handle having a locked position wherein the first arm is connectable with the printing apparatus and an unlocked position wherein the first arm is detachable from the printing apparatus;

a spring for biasing said handle toward the locked position; and a pin connected to the first arm, a first end of said pin extending from the first arm for engaging with said body and a second end of said pin adapted for engagement with said biasing means.

7. The printing apparatus of claim 6, wherein the first end of said pin and the second end of said pin are interchangeable.

8. A printing apparatus including a media tray for storing a supply of media for use in the printing apparatus, the media tray comprising:

a body including a tray for storing the media;

a cover including a front face thereof, the front face opposed to said body, the cover defining an opening therein, said cover attached to a first end of said body; and a handle pivotably secured to said cover about a handle pivoting axis, said handle positioned at least partially adjacent the opening of the cover, said handle removably connectable with the printing apparatus, the handle pivoting axis being located outside the volume normal to the face whose cross sectional area is defined by the predetermined periphery of the opening of the cover at the front face, said handle including a first arm extending outwardly from said pivoting axis, said handle having a locked position wherein the first arm is connectable with the printing apparatus and an unlocked position wherein the first arm is detachable from the printing apparatus, said handle including a second arm extending outwardly from said pivoting axis, the front face including a face front surface thereof, the front surface opposed to said body, the second arm including a second arm front surface thereof, the front surface of the second arm opposed to said body.

9. The printing apparatus of claim 8, wherein the second arm front surface is extends beyond the front face of said cover when said handle is in the locked position.

10. A printing apparatus including a media tray for storing a supply of media for use in the printing apparatus, the media tray comprising:

a body including a tray for storing the media;

a cover including a front face thereof, the front face opposed to said body, the cover defining an opening therein, said cover attached to a first end of said body; and a handle pivotably secured to said cover about a handle pivoting axis, said handle positioned at least partially adjacent the opening of the cover, said handle removably connectable with the printing apparatus, the handle pivoting axis being located outside the volume normal to the face whose cross sectional area is defined by the predetermined periphery of the cover at the front face, said handle including a first arm extending outwardly from said pivoting axis, said handle having a locked position wherein the first arm is connectable with the printing apparatus and an unlocked position wherein the first arm is detachable from the printing apparatus and said handle including a second arm extending outwardly from said pivoting axis, the front face including a face front surface thereof, the front surface opposed to said body, the second arm including a second arm front surface thereof, the front surface of the second arm opposed to said body; and an adjustable stop cooperable with said handle for adjusting the position of the handle when the handle is in the locked position so that the second arm front surface may be positioned with respect to the face front surface so that the second arm front surface is substantially coplanar with the face front surface.

11. The media tray of claim 3, wherein the second arm front surface and the front face of said cover extend in a substantially vertical direction.

12. The printing apparatus of claim 8, wherein the second arm front surface and the front face of said cover extend in a substantially vertical direction.

* * * * *

UNITED STATES PATENT AND TRADEMARK OFFICE

CERTIFICATE OF CORRECTION

PATENT NO. : 5,918,875
DATED : July 6, 1999
INVENTOR(S) : Masley et al.

It is certified that error appears in the above-identified patent and that said Letters Patent is hereby corrected as shown below:

Column 10,
Line 50, please replace [biasing means] with -- spring --.

Signed and Sealed this

Twenty-fifth Day of December, 2001

*Attest:*

*Attesting Officer*

JAMES E. ROGAN
*Director of the United States Patent and Trademark Office*